US005323946A

United States Patent [19]

O'Connor et al.

[11] Patent Number: 5,323,946

[45] Date of Patent: Jun. 28, 1994

[54] BLIND RIVET SETTING TOOL

[75] Inventors: William E. O'Connor, Watertown; Victor A. Krasenics, Orange, both of Conn.

[73] Assignee: Emhart Inc., Newark, Del.

[21] Appl. No.: 963,112

[22] Filed: Oct. 19, 1992

[51] Int. Cl.[5] ..... B21J 15/28

[52] U.S. Cl. ..... 227/2; 227/51; 29/243.525

[58] Field of Search ..... 227/51, 53, 54, 55, 227/2; 29/243.53, 243.521, 243.525, 243.526; 72/391.2, 391.4

[56] References Cited

U.S. PATENT DOCUMENTS 4,259,858 4/1981 Freeman et al. ..... 227/51

4,275,583 6/1981 Gilbert et al. ..... 29/243.525

4,597,263 7/1986 Corbett ..... 29/243.525

5,072,501 12/1991 Vincenzo ..... 29/243.525

5,098,001 3/1992 Smart et al. ..... 227/51

*Primary Examiner*—Scott Smith

*Attorney, Agent, or Firm*—Edward D. Murphy

[57] ABSTRACT

A tool for setting blind rivets. The load of the motor which drives the pulling head between fully forward and retracted positions is monitored. When the pulling head is displaced to set a rivet motor direction will be changed if a moderate load is not sensed in a short period of time or if following such sensing of a moderate load the sensed low drops to a minimum value. When the pulling head is displaced in the opposite direction a stop will be engaged at the fully forward position and the sensing of a moderate load will stop the motor.

3 Claims, 5 Drawing Sheets

BLIND RIVET SETTING TOOL

The present invention relates to tools for setting blind rivets which have a headed mandrel and a flanged body.

Tools for setting blind rivets such as disclosed in U.S. Pat. No. 4,517,820 rely on hydraulically intensified air pressure to axially displace a pulling head to set a rivet. Such tools are quite expensive.

It is an object of the present invention to provide a low cost tool for setting blind rivets by making a few modifications to a standard hand drill.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
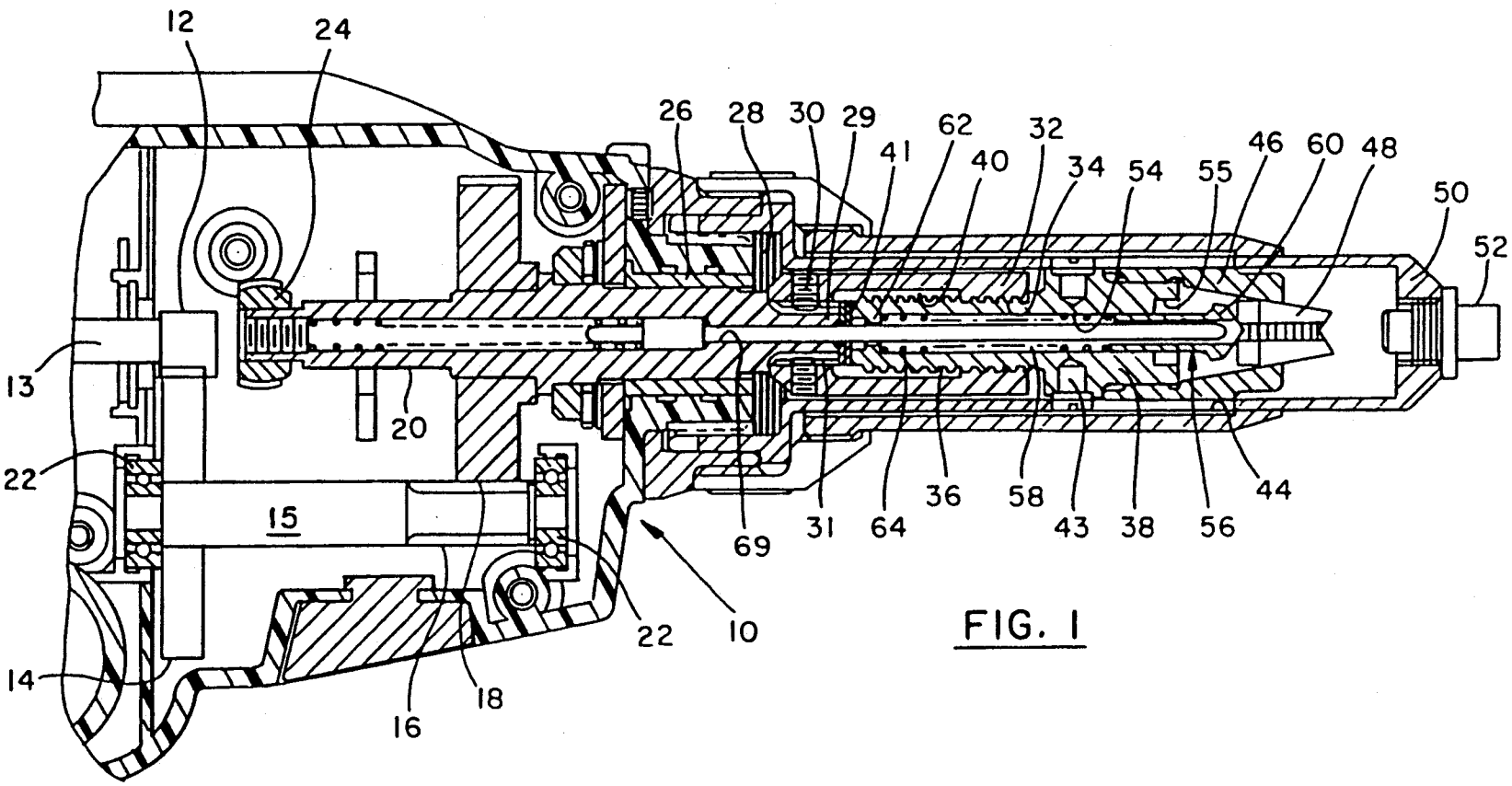
FIG. 1 is an elevational cross sectional view of a tool for setting blind rivets made in accordance with the teachings of the present invention.

The tool 10 has a drive gear 12 which is secured to the reversible motor output shaft 13. To reduce the output R.P.M., the drive gear 12 drives a large gear 14 which is secured to a drive shaft 15 having a pinion 16 defined at the forward end and that pinion 16 drives another large gear 18 which is secured to the tool output shaft 20. The drive shaft 15 is suitably supported in a pair of bearings 22 and the tool output shaft 20 is supported between spaced bushings 24, 26 and a thrust bearing 28.

Secured to the reduced diameter front end 29 of the tool output shaft 20 by a pair of set screws 30 which set on suitable flat surfaces 31 is a cylindrical adaptor 32 which has a threaded (Acme) bore 34 at the front end for threadedly receiving the threaded (Acme) end 36 of the body 38 of the pulling head assembly. The interior 40 of the adaptor 32 is enlarged to provide a clearance between the threaded end of the body and the adaptor 32 and located between the front end of the tool output shaft and the rear end of the pulling head body 38 are three cylindrical Bellville springs 41. When the tool output shaft 20 and hence the adaptor 32 rotate, the pulling head body 38, which is keyed to the nose housing 50 by screw heads 43 received in axially extending housing slots 44, will axially displace forwardly or rearwardly depending on motor direction. Secured to the front of the pulling head body 38 is a jaw holder or guide 46, and jaws 48 and secured to the front of the adaptor housing 41 is a nose housing 50 which supports the nosepiece 52.

Located within an axial bore 54 in the pulling head body 38 which has an enlarged portion 55 is a jaw expander or pusher 56 which is made up of a tubular body 58 which is slidably received in the axial bore 54 and wedge shaped end 60 which is partially received by the enlarged entrance portion 55 of the axial bore 54. A compression spring 64 is located between the rear end of the pusher 56 and a reduced diameter flange 62 at the rear end of the axial bore 54. The forward beveled faces of the pusher engage corresponding faces of the jaws. Extending from the central bore 69 of the tool output shaft 20 to the central passageway 67 of the pusher 56 is a mandrel ejector 70.

Figure 2:
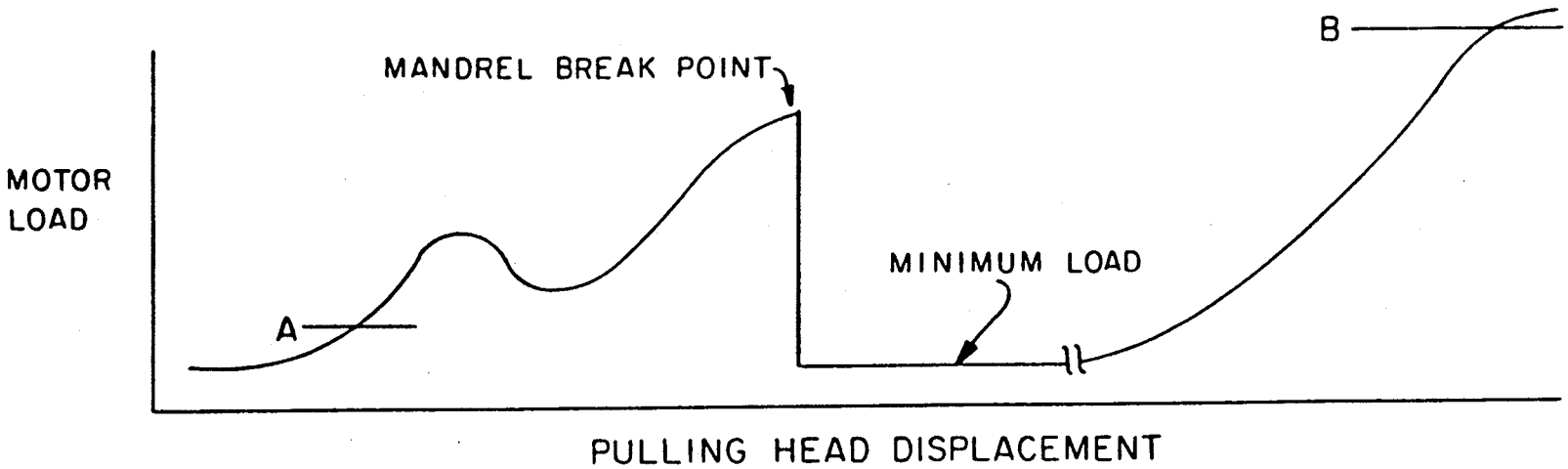
FIG. 2 is a graph showing motor load as a function of pulling head displacement.

FIG. 2 is a graph showing motor load vs. pulling head displacement for the tool operated in accordance with the invention. If there is a rivet in the nosepiece, the motor load will begin to increase from minimal load when the jaws engage the mandrel. As the cycle continues, motor load will follow the illustrated curve which is determined by the rivet setting process. As shown motor load will first increase, then dip and finally will again rise until the mandrel breaks whereupon motor load will decrease to the minimum value. In the event the motor continues to run until the pulling head stops against the compressed Bellville washers, the motor load may reach a yet greater value, than that required to break the mandrel as the motor approaches stall conditions. When the direction of the motor is reversed to drive the pulling head back to the full forward position the front of the pulling head assembly will impact against the nosepiece causing the load to again increase above the minimum load.

Figure 3:
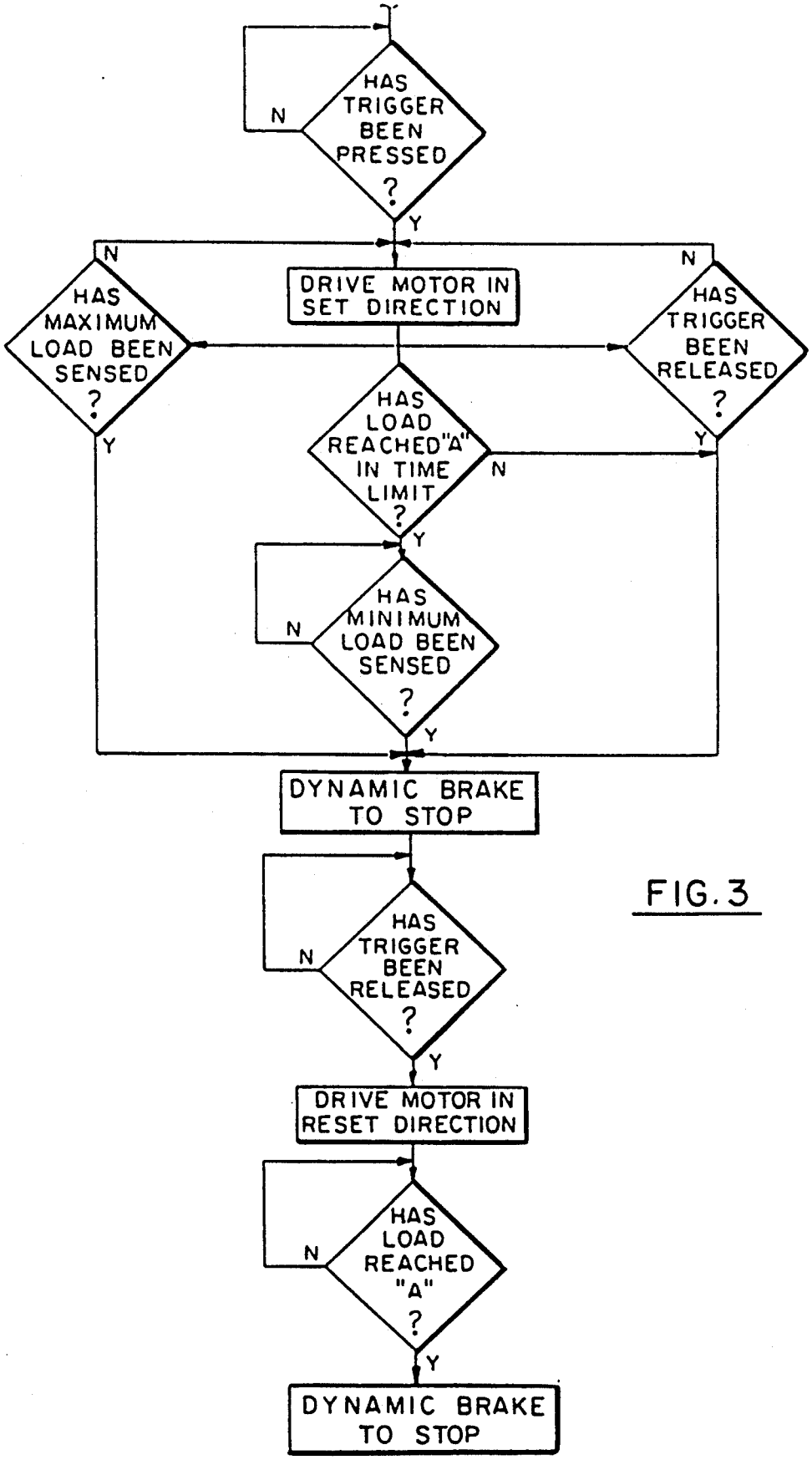
FIG. 3 is a logic diagram of the control system.

The logic diagram for the tool is illustrated in FIG. 3. Pressing the trigger starts the cycle by driving the motor in the rivet setting direction. If at any time before the cycle is complete, the operator releases the trigger the drive motor will be dynamically braked for a period of time sufficient to assure that it has been stopped and the direction of the drive motor will be reversed to return the tool to the start condition. When the pulling head impacts against the nosepiece increasing the motor load to moderate load A the motor will again be dynamically braked to a stop. If a rivet is present and the trigger is held in the pressed position, the motor load should quickly reach a moderate load A which is above the minimum motor load. If load A is not reached within a selected time T no rivet is present. The drive motor will be stopped and when the trigger is released, reversed as already described to return the pulling head to the start position. If load A is reached in time T the control looks for minimum load as a signal that the rivet has been set and the mandrel broken off. Upon sensing this minimal load the motor will be stopped and then it will be driven in the reverse direction if the trigger is released. In the event that the mandrel does not break and the motor approaches stall conditions against the Bellville springs (motor load increases to maximum load B), the motor will again be dynamically braked and the direction will be reversed if the trigger is released. Once reversed the control looks for moderate load A indicating that the pulling head is in the fully forward position to stop the motor.

Figure 4:
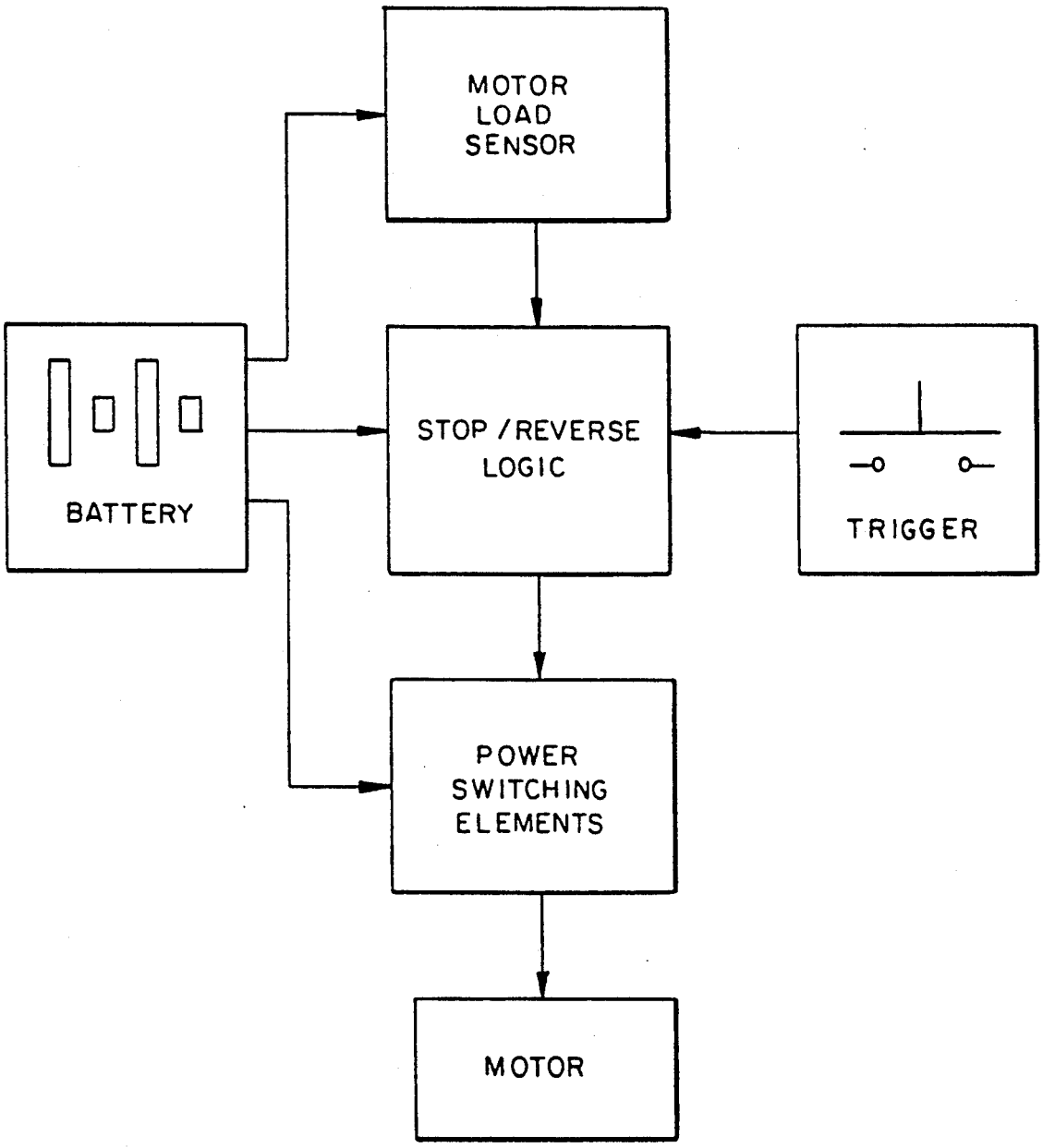
FIG. 4 is a system block diagram.
Figure 5:
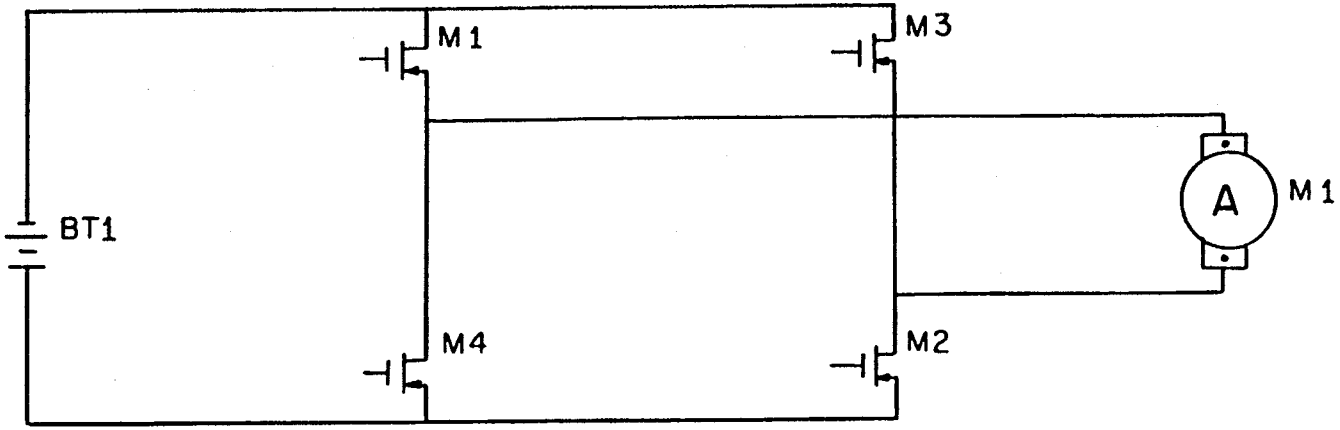
FIG. 5 is a schematic drawing of one switching circuit.
Figure 6:
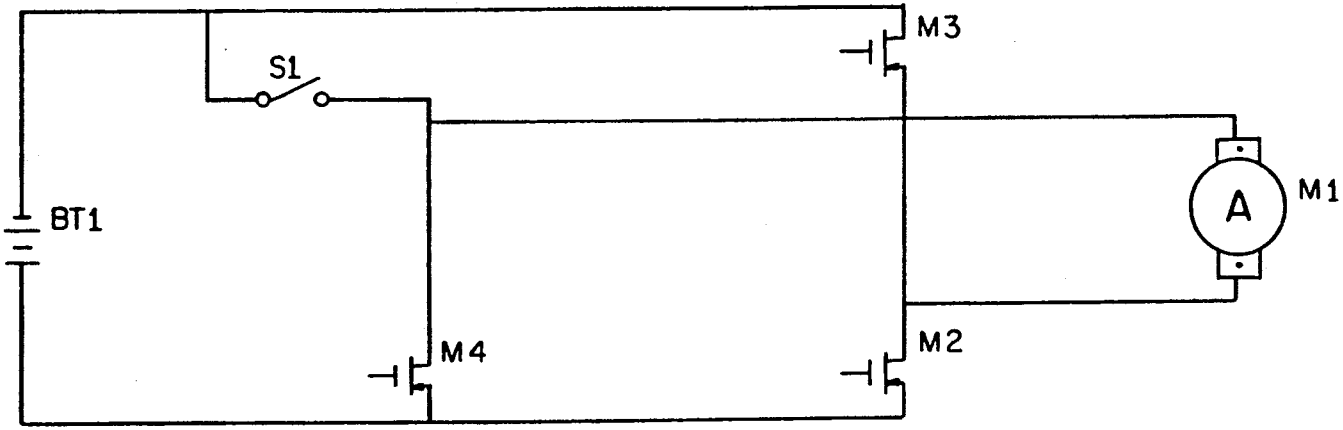
FIG. 6 is a schematic drawing of a second switching circuit.

FIG. 4 shows the system block diagram for a battery BT1 powered tool. In this embodiment the reversing circuit of the Stop/Reverse Logic can be a conventional four transistor (M1–M4) bridge circuit as shown in FIG. 5 or it can be a bridge circuit including three transistors (M1–M3) and the tool trigger switch S1 as shown in FIG. 6.

I claim:

1. A tool for setting a blind rivet having a mandrel comprising a pulling head assembly, means for displacing said pulling head assembly towards and away from a fully forward position including a motor, means for sensing the load of said motor, said load varying from a minimum load, to a mandrel breaking load, and to a higher motor stall load, with a moderate load being greater than said minimum load but less than said mandrel breaking load, means for controlling the displacement of said pulling head assembly away from said fully forward position including means for operating said motor in a selected direction, means for starting said operating means, means for determining whether said moderate load is sensed within a selected period of time from the time when said operating means is started, means for stopping said motor upon the first occurrence of one of (a) expiration of said selected time period without sensing of said moderate load, and (b) sensing of said moderate load within said selected time period followed by sensing of said minimum load.

2. A tool according to claim 1 further comprising stop means for preventing the forward displacement of said pulling head assembly beyond said fully forward position, and means for stopping said motor, while said motor is displacing said pulling head assembly toward said fully forward position when said load reaches said moderate load.

3. A tool according to claim 1, wherein said starting means comprises a trigger selectively movable from an inoperative position to an operative position and said stopping means includes means for stopping said motor and operating said motor to move said pulling head toward said fully forward position if said trigger is moved from said operative position to said inoperative position.

* * * * *